US005909919A

United States Patent [19]

Wang

[11] Patent Number: 5,909,919

[45] Date of Patent: Jun. 8, 1999

[54] AUXILIARY LOCK ASSEMBLY WITH ADDITIONAL INTERIOR LOCKING

[75] Inventor: Jen-Feng Wang, Kaohsiung Hsien, Taiwan

[73] Assignee: Taiwan Fu Hsing Industry Co., Ltd., Kaohsiung Hsien, Taiwan

[21] Appl. No.: 08/946,251

[22] Filed: Oct. 7, 1997

[51] Int. Cl.[6] ..... E05B 55/04

[52] U.S. Cl. ..... 292/359; 292/169.15

[58] Field of Search ..... 292/169.15, 169.18, 292/336.3, 359; 70/477, 480, 481

[56] References Cited

U.S. PATENT DOCUMENTS

| | | | |
|---|---|---|---|
| 365,775 | 7/1887 | Bennett . | |
| 1,760,394 | 5/1930 | Best . | |
| 2,505,188 | 4/1950 | Kaiser . | |
| 2,636,376 | 4/1953 | McConnell . | |
| 2,989,332 | 6/1961 | Gilbert . | |
| 3,954,292 | 5/1976 | Johnson | 292/169.17 |
| 4,055,361 | 10/1977 | Moses | 292/359 |
| 4,142,748 | 3/1979 | Hook | 292/169.15 |
| 5,364,139 | 11/1994 | Bergen | 292/169 |

*Primary Examiner*—Darnell M. Boucher
*Assistant Examiner*—Gary Estremsky
*Attorney, Agent, or Firm*—Bacon & Thomas, PLLC

[57] ABSTRACT

An auxiliary lock assembly includes a casing securely attached to the inner side of the door plate and including a first hole, a mount plate securely attached to the casing and including a second hole in alignment with the first hole, and a latch plate mounted on the mount plate and movable in a direction toward and away from the second hole. The latch plate has a first end extending beyond the casing and a second end inside the casing. An engaging wheel is rotatably received in the second hole of the mount plate and releasably engages with the second end of the latch plate. An actuating wheel is rotatably received in the first hole of the casing and is rotatable to a position to engage with the engaging wheel to rotate therewith. A switch button is mounted outside the casing and securely attached to the actuating wheel to rotate therewith. When the auxiliary lock assembly is in a lock position, unlocking from an outside of the door plate is prevented when the second end of the latch plate is engaged with the engaging wheel.

7 Claims, 4 Drawing Sheets

AUXILIARY LOCK ASSEMBLY WITH ADDITIONAL INTERIOR LOCKING

BACKGROUND OF THE INVENTIN

1. Field of the Invention

The present invention relates to an auxiliary lock assembly with additional interior locking function to prevent from unlatching from outside.

2. Description of the Related Art

Auxiliary locks have been widely used indoors. The auxiliary locks can be unlatched from outside by a proper key or picklock, i.e., doors mounted with auxiliary locks still can be opened, which is sometimes undesired and even dangerous to, e.g., people which have fallen asleep in the night. The present invention is intended to provide an improved auxiliary lock assembly which mitigates and/or obviates the above problems.

SUMMARY OF THE INVENTION

It is an object of the present invention to provide an auxiliary lock assembly which can be latched from inside such that the lock assembly cannot be unlatched from outside even if a proper key is used.

An auxiliary lock assembly in accordance with the present invention is mounted to an inner side of a door plate. The auxiliary lock assembly comprises a casing securely attached to the inner side of the door plate and including a first hole, a mount plate securely attached to the casing and including a second hole in alignment with the first hole, and a latch plate mounted on the mount plate and movable in a direction toward and away from the second hole. The latch plate has a first end extending beyond the casing and a second end inside the casing. An engaging wheel is rotatably received in the second hole of the mount plate and releasably engages with the second end of the latch plate. An actuating wheel is rotatably received in the first hole of the casing and is rotatable to a position to engage with the engaging wheel to rotate therewith. A switch button is mounted outside the casing and securely attached to the actuating wheel to rotate therewith.

When the auxiliary lock assembly is in a lock position, unlocking from an outside of the door plate is prevented when the second end of the latch plate is engaged with the engaging wheel.

In an embodiment of the invention, the engaging wheel includes a protrusion formed on an outer periphery thereof, and the second end of the latch plate includes a notch for releasably receiving the protrusion. The second end of the latch plate includes two beveled side walls between which the notch is defined, and the actuating wheel includes at least one arcuate section formed on an end thereof located inside the casing for engaging with one of the protrusion and the beveled side walls.

In a preferred embodiment of the invention the actuating wheel includes two arcuate sections formed on an end thereof located inside the casing for engaging with one of the protrusion and the beveled side walls, and the actuating wheel further includes two parallel straight sections formed between the arcuate sections. Preferably, the casing includes two parallel elastic members mounted to an inner wall thereof for retaining the actuating wheel in position. The elastic members normally engage with the straight sections of the actuating wheel, and the elastic members are bent by the arcuate sections when the actuating wheel is rotated. Each elastic member intersects with the first hole of the casing.

The latch plate may further include a restraining member mounted thereon for guiding rectilinear movement of the latch plate. The restraining member may include a stop for limiting a maximum movement of the latch plate.

Other objects, advantages, and novel features of the invention will become more apparent from the following detailed description when taken in conjunction with the accompanying drawings.

DESCRIPTION OF THE PREFERRED EMBODIMENT

Figure 1:
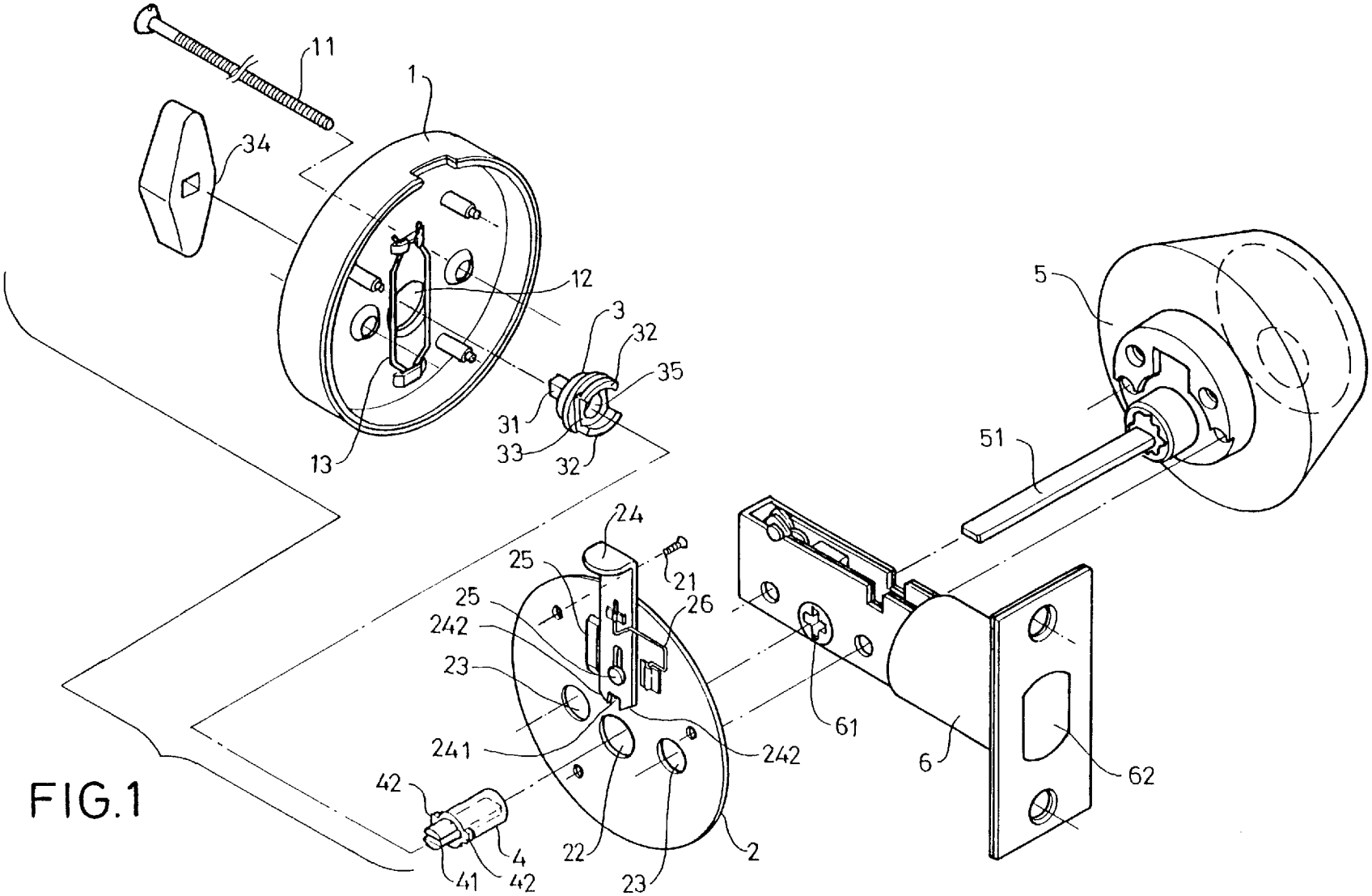
FIG. 1 an exploded perspective view of an auxiliary lock assembly in accordance with the present invention.
Figure 3:
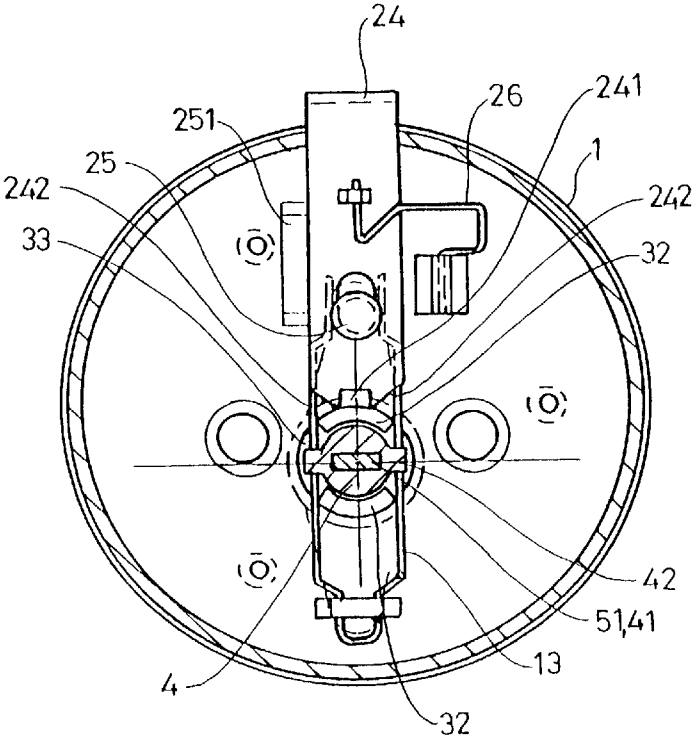
FIG. 3 is a sectional view taken along line 3—3 in FIG. 2.
Figure 2:
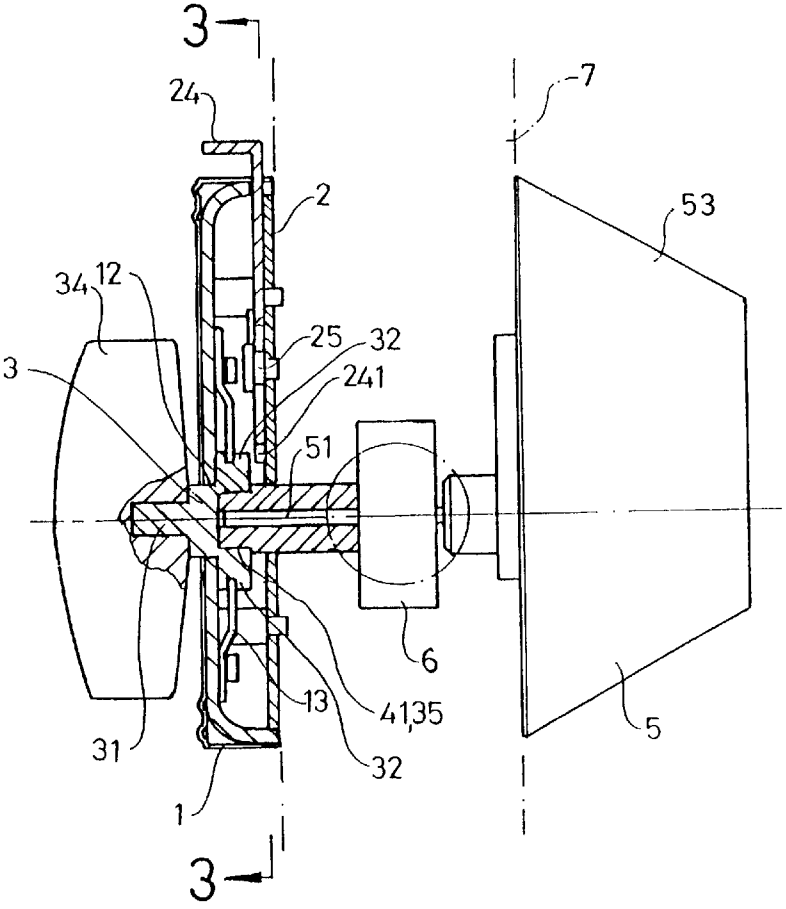
FIG. 2 is a side view, partially sectioned, of the auxiliary lock assembly in with the present invention.

Referring to the drawings and initially to FIGS. 1 to 3, an auxiliary lock assembly in accordance with the present invention generally includes an exterior lock assembly 5 mounted to an outer side of a door plate 7 (FIG. 2) and having an actuating piece 51, an interior lock assembly, and a latch assembly 6 having a latch bolt 62 and two wheels 61, wherein the actuating piece 51 is extended through the wheels 61, and a rotational movement of a knob 53 of the exterior lock assembly 5 causes rotational movements of the actuating piece 51 and the wheels 61, which, in turn, causes the latch bolt 62 to extend into or retract from a cavity (not shown) defined in a door frame (not shown), which is conventional and therefore not further described.

The interior lock assembly includes a casing 1 attached to an inner side of the door plate 7 by bolts 11 which are also extended into holes 64 defined in the latch assembly 6 and screw holes 52 defined in the exterior lock assembly 5. The casing 1 includes a central hole 12 and two parallel elastic members 13 mounted to an inner wall thereof. Each elastic member 13 intersects with the central hole 12, best shown in FIG. 1.

A mount plate 2 is mounted to seal an opening (not labeled) of the casing 1 by screws 21. The mount plate 2 includes a central hole 22 for rotatably receiving an engaging wheel 4 and two holes 23 through which the bolts 11 extend. The mount plate 2 further includes a latch plate 24 which is retrained by a restraining member 25 also mounted to the mount plate 2. In this embodiment, as shown in FIG. 1, the restraining member 25 includes a guiding stop 251 formed thereon, while the latch plate 24 includes a slot 243 extending in a direction toward the central hole 22 of the mount plate 2, wherein the slot 243 has a width smaller than that of the guiding stop 251, thereby preventing the latch plate 24 from being disengaged from the restraining member 25 while guiding the latch plate 24 to move in a direction toward or away from the central hole 22. In addition, an elastic member 26, having a first end attached to the mount plate 2 and a second end attached to the latch plate 24, is provided to bias the latch plate 24 away from the central hole 22 such that a distal end (preferably a flat section for easy grasp) of the latch plate 24 is extended beyond a slot 14 defined in a periphery of the casing 1 for easy operation. The latch plate 24 further includes a notch 241 defined in an end thereof which is adjacent to the central hole 22. In addition, two side walls 242 of the end, between which the notch 241 is defined, is beveled, which will be described later.

An actuating wheel 3 is rotatably mounted in the central hole 12 and includes a non-circular axle 31 engaged with a switch button 34 mounted outside the casing 1 for manual operation. The actuating wheel 3 further includes a two spaced arcuate sections 32 formed on an end thereof located inside the casing 1 and two parallel straight sections 33 mounted between the arcuate sections 32. Further, the actuating wheel 3 includes a recess 35 defined in an inner side thereof for receiving an end 41 of the engaging wheel 4 which, in turn, is rotatably received in the central hole 22 of the mount plate. In addition, the actuating piece 51 is extended into the engaging wheel 4 to rotate therewith, best shown in FIG. 2. The engaging wheel 4 further includes two protrusions 42 formed on an outer periphery thereof, and the actuating wheel 3 may be rotated to a position to engage with the protrusions 42 so as rotate with the engaging wheel 4, which will be described later.

Referring to FIGS. 2 and 3, the lock assembly is in an unlocked position, wherein the latch plate 24 is at a higher position, and the notch 241 of the latch plate 24 disengages from the protrusion 42. If a proper key is inserted into the exterior lock assembly 5 and rotated through a pre-determined angle, the actuating piece 51 and the wheels 61 are turned to extend the latch bolt 62 into the cavity in the door frame, thereby achieving the locking function. Alternately, if the switch button 34 is rotated through a pre-determined angle, one of the arcuate sections 32 of the actuating wheel 3 bears against one of the protrusions 42 of the engaging wheel 4 and thus causes the engaging wheel 4 and the actuating piece 51 to turn, thereby also achieving the locking function, as shown in FIG. 4.

Figure 5:
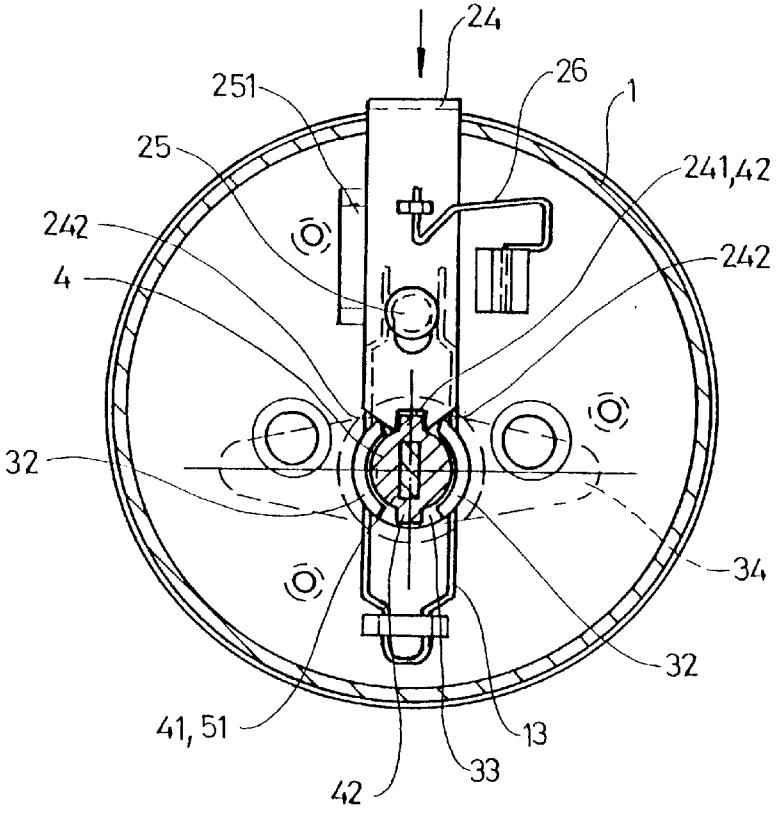
FIG. 5 is a similar to FIG. 4, in which a latch plate is lowered.
Figure 4:
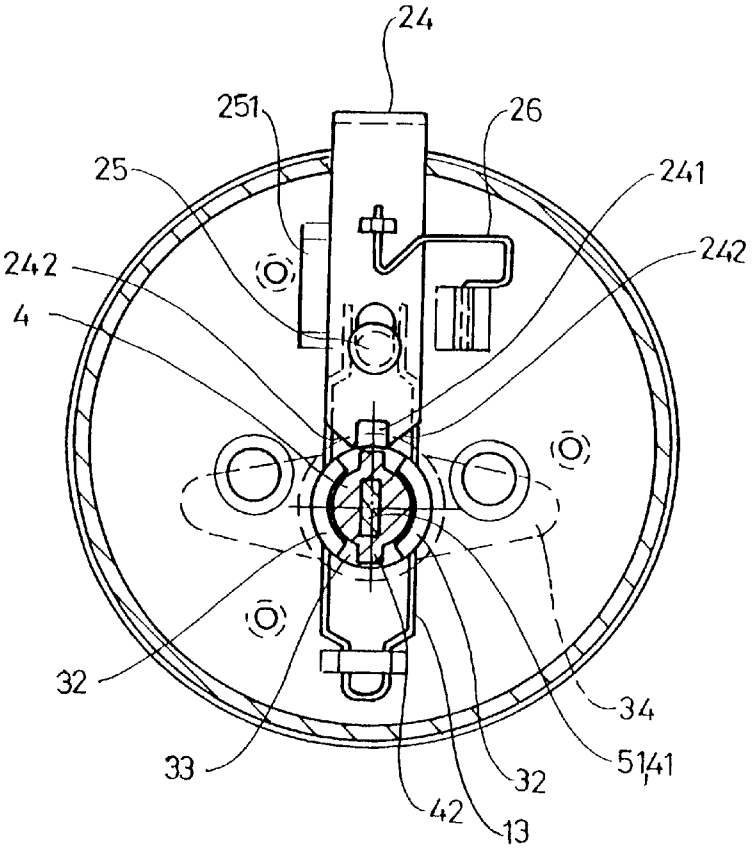
FIG. 4 is a view similar to FIG. 3, in which a switch button is rotated through 90 degrees.
Figure 6:
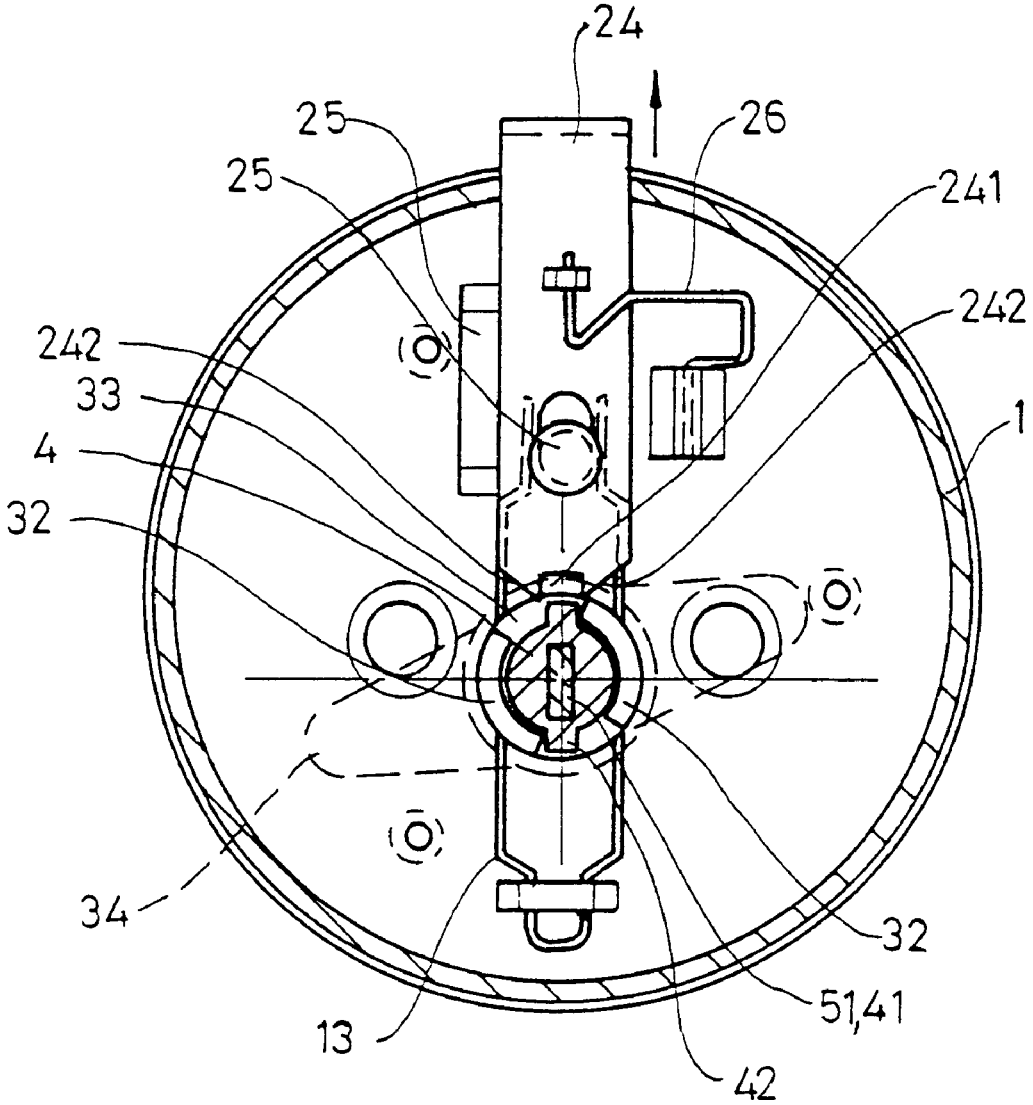
FIG. 6 is a view similar to FIG. 5, illustrating unlatching from inside.

When the lock assembly is in a status shown in FIG. 4, the latch plate 24 may be pressed to move downwardly to a position shown in FIG. 5, wherein the notch 241 of the latch plate 24 is lowered to engage with one of the protrusions 42, thereby providing a further latching. In this case, even though a proper key is inserted into the exterior lock assembly, the actuating piece 51 still cannot be turned, i.e., the auxiliary lock assembly cannot be unlocked from outside. This may be required in some cases, e.g., when one is going to sleep, the additional latching of the latch plate 24 may prevent from burglars using a picklock. Nevertheless, the auxiliary lock assembly still can be unlocked from inside. More specifically, if the switch button 34 is rotated through an angle, as shown in FIG. 6, one of the arcuate sections 32 bears against one of the beveled side walls 242 of the latch plate 24 and thus urges the latch plate 24 to move upwardly away from and thus disengages from the protrusion 42 of the engaging wheel 4. Thus, further rotational movement of the switch button 34 may achieve the required unlocking function in a manner described above.

It is appreciated that the parallel elastic members 13 are normally engaged with the straight sections 33 of the actuating wheel 3 to retain the actuating wheel 3 in position. When the actuating wheel 3 is rotated, the elastic members 13 are bent outwardly when they engage with the arcuate sections 32 of the actuating wheel 3. In addition, the guiding stop 251 of the restraining member 25 may act as a stop to limit a maximum movement of the latch plate 24 when the stop 251 engages with an end edge of the slot 243 of the latch plate 24.

It is further appreciated that the auxiliary lock assembly in accordance with the present invention may only comprise the interior lock assembly as the exterior lock assembly 5 and the latch assembly 62 may have various forms and modifications and thus should not become a limitation to the invention.

Although the invention has been explained in relation to its preferred embodiment, it is to be understood that many other possible modifications and variations can be made without departing from the spirit and scope of the invention as hereinafter claimed.

What is claimed is:

1. An auxiliary lock assembly mounted to an inner side of a door plate, the auxiliary lock assembly comprising:

a casing securely attached to the inner side of the door plate and including a first hole;

a mount plate securely attached to the casing and including a second hole in alignment with the first hole;

a latch plate mounted on the mount plate and movable in a direction toward and away from the second hole, the latch plate having a first end extending beyond the casing and a second end inside the casing;

an actuating piece which is rotated between a lock position and an unlock position by an exterior locking assembly from an outer side of the door plate;

an engaging wheel rotatably received in the second hole of the mount plate, connected to the actuating piece for rotation therewith, and releasably engageable with the second end of the latch plate;

an actuating wheel rotatably received in the first hole of the casing, the actuating wheel being rotatable to a position to engage with the engaging wheel to rotate therewith;

a switch button mounted outside the casing and securely attached to the actuating wheel to rotate therewith;

whereby when the auxiliary lock assembly is in the lock position, turning the actuating piece to the unlock position from the outer side of the door plate is prevented by the second end of the latch plate being engaged with the engaging wheel;

and wherein the latch plate and actuating wheel have means for moving the latch plate to an unlocked position by rotation of the switch button.

2. The auxiliary lock assembly according to claim 1, wherein the engaging wheel includes a protrusion formed on an outer periphery thereof, and the second end of the latch plate includes a notch for releasably receiving the protrusion.

3. The auxiliary lock assembly according to claim 2, wherein the second end of the latch plate includes two beveled side walls between which the notch is defined, and the actuating wheel includes at least one arcuate section formed on an end thereof located inside the casing for engaging with one of the protrusion and the beveled side walls.

4. The auxiliary lock assembly according to claim 2, wherein the actuating wheel includes two arcuate sections formed on an end thereof located inside the casing for engaging with one of the protrusion and the beveled side walls, the actuating wheel further includes two parallel straight sections formed between the arcuate sections.

5. An auxiliary lock assembly mounted to an inner side of a door plate, the auxiliary lock assembly comprising:

a casing securely attached to the inner side of the door plate and including a first hole;

a mount plate securely attached to the casing and including a second hole in alignment with the first hole;

a latch plate mounted on the mount plate and movable in a direction toward and away from the second hole, the latch plate having a first end extending beyond the casing and a second end inside the casing;

an engaging wheel rotatable received in the second hole of the mount plate, and releasably engageable with the second end of the latch plate;

an actuating wheel rotatably received in the first hole of the casing, the actuating wheel being rotatable to a position to engage with the engaging wheel to rotate therewith;

a switch button mounted outside the casing and securely attached to the actuating wheel to rotate therewith;

whereby when the auxiliary lock assembly is in a lock position, unlocking from an outside of the door plate is prevented when the second end of the latch plate is engaged with the engaging wheel;

wherein the engaging wheel includes a protrusion formed on an outer periphery thereof, and the second end of the latch plate includes a notch for releasably receiving the protrusion;

wherein the second end of the latch plate includes two beveled side walls between which the notch is defined, and the actuating wheel includes at least one arcuate section formed on an end thereof located inside the casing for engaging with one of the protrusion and the beveled side walls;

wherein the actuating wheel includes two arcuate sections formed on an end thereof located inside the casing for engaging with one of the protrusion and the beveled side wall, the actuating wheel further includes two parallel straight sections formed between the arcuate sections; and wherein the casing includes two parallel elastic members mounted to an inner wall thereof for retaining the actuating wheel in position, wherein the elastic members normally engage with the straight sections of the actuating wheel, and the elastic members are bent by the arcuate sections when the actuating wheel is rotated, and each said elastic member intersects with the first hole of the casing.

6. The auxiliary lock assembly according to claim 1, wherein the latch plate further includes a restraining member mounted thereon which guides rectilinear movement of the latch plate.

7. The auxiliary lock assembly according to claim 6, wherein the restraining member includes a stop for limiting a maximum movement of the latch plate.

* * * * *